United States Patent [19]

Henkel

[11] Patent Number: 4,811,559

[45] Date of Patent: Mar. 14, 1989

[54] APPARATUS FOR REMOVING SOOT FROM THE EXHAUST GASES OF AN INTERNAL COMBUSTION ENGINE

[75] Inventor: Dietmar Henkel, Neumarkt, Fed. Rep. of Germany

[73] Assignee: Man Nutzfahrzeuge GmbH, Munich, Fed. Rep. of Germany

[21] Appl. No.: 116,618

[22] Filed: Nov. 3, 1987

[30] Foreign Application Priority Data

Nov. 3, 1986 [DE] Fed. Rep. of Germany ..... 3637331

[51] Int. Cl.[4] ..... F01N 3/02

[52] U.S. Cl. ..... 60/303; 55/466; 55/520; 55/DIG. 30; 60/311

[58] Field of Search ..... 60/303, 311; 55/466, 55/520, DIG. 30

[56] References Cited

U.S. PATENT DOCUMENTS

| | | | |
|---|---|---|---|
| 3,843,561 | 10/1974 | Sobel | 55/520 |
| 4,211,075 | 7/1980 | Ludecke | 60/311 |
| 4,276,066 | 6/1981 | Bly | 60/311 |
| 4,324,572 | 4/1982 | Erdmannsdorfer | 55/520 |

*Primary Examiner*—Douglas Hart

*Attorney, Agent, or Firm*—Becker & Becker

[57] ABSTRACT

An apparatus for removing soot from the exhaust gases of an internal combustion engine with the aid of a winding filter (surface filter) that is disposed on a support member. In order to burn off the soot in a controlled manner, this filter insert is provided with an appropriate electrode configuration. To simplify the electrode arrangement, and to improve the degree of soot deposition, the support member is designed as a wound or wrapped cage that undertakes the electrode arrangement, and untwisted roving threads, which are wound parallel to the periphery, i.e. at right angles to the axis of the wound cage, are used for forming the wrap structure.

12 Claims, 2 Drawing Sheets

APPARATUS FOR REMOVING SOOT FROM THE EXHAUST GASES OF AN INTERNAL COMBUSTION ENGINE

BACKGROUND OF THE INVENTION

The present invention relates to an apparatus for removing soot or particulates from the exhaust gases of an internal combustion engine, in particular a Diesel engine. The apparatus includes a metallic housing with inlet and outlet connectors for the exhaust gas flow, and a filter insert that is disposed in the housing and contains a non-metallic, high-temperature-resistant filter means in the form of a wrap structure mounted on a support member, with the filter insert, in the filter housing, separating an untreated-gas chamber from a clean-gas chamber, and an electric current source being used to burn off, in a controlled manner, the soot deposited on the filter means; for this purpose the filter insert is provided with an appropriate electrode configuration.

An apparatus of this general type is described in applicant's copending U.S. patent application, Ser. No. 069,609 Henkel, filed July 2, 1987, belonging to the assignee of the present invention. In that apparatus, surface filters are used that are produced by winding or wrapping a perforated tubular member with a dense quartz glass or ceramic fiber fabric, which has an orthogonal fiber structure. In this connection, wire electrodes wound in a double helix are used for fixing the fabric winding and for introducing the electrical auxiliary energy into the layer of soot deposited on the winding surface over which the flow passes. In this case the soot itself acts as an electrical heat conductor.

The production of surface filters of this type (in particular of the electrode configuration) is very expensive. In addition, a deposition of soot occurs that is not optimum.

It is therefore an object of the present invention, in the case of the surface filter of the type described above, on the one hand to provide a design of the electrode configuration that is less expensive to produce, and on the other hand to produce a very high degree of soot deposition.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 2:
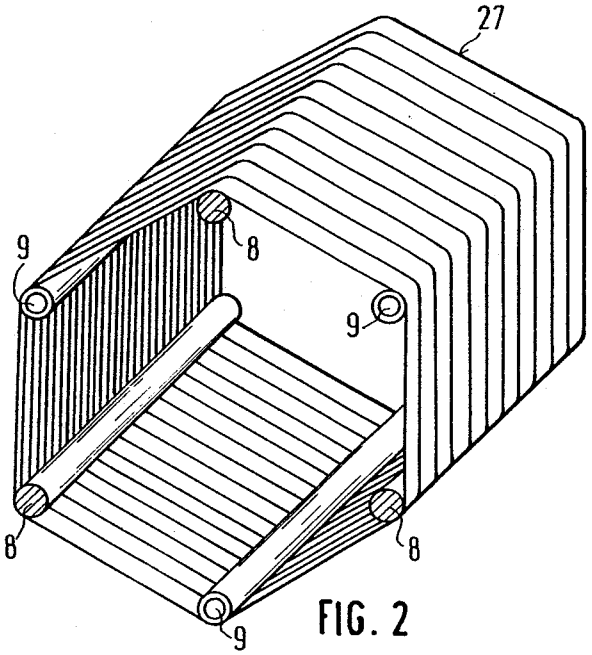
FIG. 2 is a view that shows the wound or wrapped cage formed by the support pins and the tubular elements, with the winding filter according to FIG. 1.

The apparatus of the present invention is characterized primarily in that the support member is designed as a wrapped cage that undertakes the electrode arrangement, and in that untwisted roving threads, which are wound parallel to the circumference, i.e. at right angles to the axis of the wrapped cage, are used for forming the wrap structure.

By means of the present invention, the support member at the same time undertakes the electrode configuration or the function of a wound or wrapped cage. The filter action proper is achieved by wrapping the support member with untwisted roving threads. The term "roving threads" refers to a thread produced from a plurality of individual fibers (for example, a roving thread that is 4 mm wide and 0.2 mm thick contains approximately 4800 individual fibers, each with a diameter of 9μ). These roving threads (of quartz glass) are wound extremely tightly (winding against winding). In so doing, a very high degree of soot deposition occurs in the capillary gaps that are oriented parallel to the individual fibers of the roving. In addition, the electrical conductivity of the layer of soot formed has a preferred direction, namely in the direction of formation of the capillary gaps, i.e. in the peripheral direction of the winding. Since this direction of the conductivity coincides with the direction of the electrical field present between the electrodes, this has the desired effect that even very small quantities of deposited soot form conductive paths that are formed in the manner of threads and can be heated electrically and consequently burned off. The practical consequence is that in the case of electrodes that are constantly switched on, there is only a very slight increase in the pressure drop of the filter winding as a result of the soot deposition process (the soot deposit is already burned off during the formation stage).

A further advantage of the winding is its ability to be able to develop an elastic resilience between the individual threads (in the axial direction of the winding). This characteristic is to be welcomed, for example, when particles of ash collect in the filter winding. The pressure drop that then increases in the winding increases in the probability of a pressure-determined enlargement of such capillary gaps (filled with ash) in which local zones of greater axial resilience linked with greater radial through-flow resistance (statistically locally distributed microinhomogeneities of the axial distribution of "resilience" and radial flow resistance) occur in the more immediate surroundings. The removal of the particles of ash from the enlarged gap is then carried out in the desired manner. The now higher gas throughput of the gap that is freed of ash again increases the probability that more particles of ash—as compared with places which have not been enlarged— will be deposited there. It is thus a sort of self-regulating process, which seeks to maintain a likewise desired homogenization of the distribution of the radial flow resistance.

Two possibilities may be considered for the structural design of the wound or wrapped support cage. On the one hand, the wound cage can be formed from a plurality of metal support pins, disposed at intervals to one another, and tubular elements, also disposed at intervals (so as to form the periphery); the support pins and tubular elements are connected to a base element and an inlet element. On the other hand, a wrapped ceramic cage can also be used that comprises a hollow cylinder, which is integral with a base element, and a flange surface which is likewise formed integrally therewith and forms part of the inlet element. In this connection, the hollow cylinder is provided on its periphery with longitudinal recesses that extend over a specific area (winding area); as a result of these recesses, crosspiece-like hollow cylindrical walls are produced between the recesses. The surfaces of the crosspieces, which support the windings, are metallized and are thus capable of acting as electrodes. In the case of the first-described design of the wound cage, the electrode functions are performed in each case by the support pins and the tubular elements in conjunction with parts of the base element and inlet element.

In order with the first design to prevent the roving from tearing due to excessive tension on the thread—as a result of the different temperature expansion coefficients of the metal parts of the base element and inlet elements relative to the roving— the ends of the tubular elements are provided on their periphery with a plurality of longitudinal slots of different lengths, as a result of which a radial springiness or elasticity is produced. This problem does not arise in the case of the ceramic design, since the cage and the filter means have the same temperature expansion coefficients. In addition, the ceramic design is less expensive in terms of production (fewer individual parts).

In order to ensure that no gas-permeable gap is present between the individual windings of the roving wrap structure, a two-layered winding is preferable. The winding, however, also could be carried out in an overlapping manner. It is also advantageous for the number of layers at the respective ends of the filter winding to be increased (radially) for sealing purposes.

DESCRIPTION OF PREFERRED EMBODIMENTS

Figure 1:
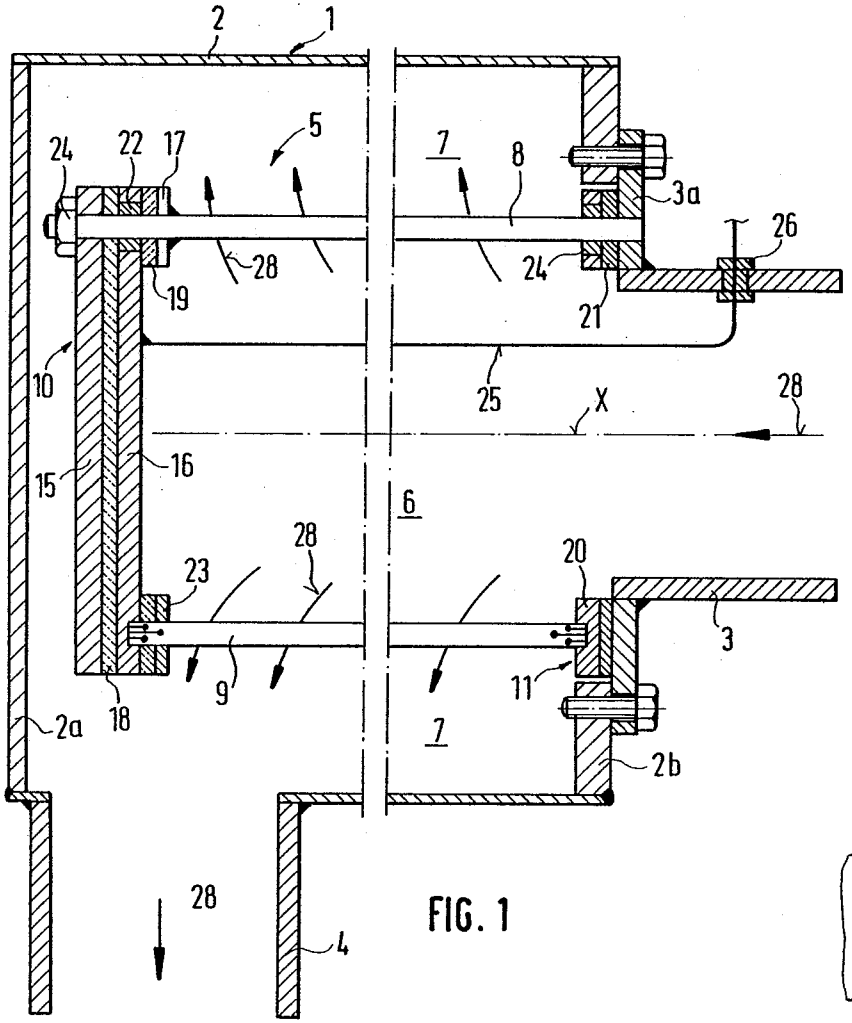
FIG. 1 is a longitudinal cross-sectional view of an apparatus according to the invention (without a filter winding)

Referring now to the drawings in detail, FIG. 1 shows a particulate or soot filter with a filter casing or housing 2, which comprises a cylindrical sheet-metal cover. One end face of the latter is closed off by a circular disk 2*a*, while the other end face is formed by an annular disk 2*b* that at the same time undertakes the function of the fastening flange for the flange surface 3*a* of an inlet socket or connector 3. An outlet socket or connector 4 is disposed radially on the housing cover 2.

A filter insert 5 is provided in the interior of the filter housing 2 and divides the latter into an untreated-gas chamber 6 and a clean-gas chamber 7. The filter insert 5 is constructed as follows: Three support pins 8 are welded, at 120° intervals from one another, to the flange part 3*a* of the inlet connector 3 to provide s support frame for a base element 10 and inlet element 11 (sandwich structure). In this conection, the base element 10 comprises two cylindrical metal plates 15 and 16 and a metal annular disk 17 that is likewise welded to the support pins 8. Respective insulating elements (disk 18 and annular disk 19) of ceramic or mica phlogopite, or textile structures of ceramic material or quartz glass, are disposed between these parts (15, 16, 17).

Figure 3:
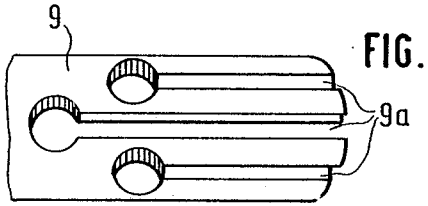
FIG. 3 is a view that shows one end of the respective tubular elements according to FIG. 1.

Respective tubular elements 9 (which are likewise disposed at 120° intervals about the periphery) are provided diametrically opposite the support pins 8 in blind holes in the inner plate 16 (of the base element 10) and in blind holes in an annular disk 20 of the inlet element 11. The ends of these tubular elements 9 are provided with longitudinal slots 9*a* of various lengths (see FIG. 3).

The outer plate 15 and the annular disk 17 (of the base element 10) undertake the function of the earth or ground electrodes in conjunction with the support pins 8. The live electrode function is undertaken by the inner plate 16 in conjunction with the tubular elements 9 and the metal annular disk 20 of the inlet element 11.

The inner plate 16 is electrically insulated from the support pins 8 with the aid of insulating disks 22. The tubular elements 9 are insulated from the annular disk 17 by insulating disks 23, and the support pins 8 are insulated from the annular disk 20 of the inlet element 11 by insulating disks 24. On the flange side of the inlet connector 3, the electrically insulating annular disk 21 ensures the insulation of the annular disk 20 from ground. The aforementioned insulating disks or insulating elements each also have a sealing function (or centering function). The positive connection of the sandwich structure is produced by means of a bolt connection 24, with support being provided by the annular disk 17 that is welded to the shafts of the support pins 8.

The filter action proper is achieved by wrapping the cage formed by the support pins 8 and the tubular elements 9. In this connection, as shown in FIG. 2, use is made of untwisted roving threads 27 which are wound extremely tightly about the cage parallel to the circumference, i.e. at right angles to the axis x of the wound or wrapped cage. In order to ensure that no gas-permeable gap is present between the individual windings, a double-layered winding is preferable.

All of the metallic materials, especially those that have to act as electrodes, are produced from non-scaling and heat-resistant metal. The same also applies to a potential-conducting lead 25 that passes out of the untreated-gas chamber 6 by way of an insulator 26.

The soot-loaded exhaust gas (see arrows 28) flow by way of the inlet connector 3 into the untreated-gas chamber 6, flows radially through the filter winding 27, and, after passing through the clean-gas chamber 7, leaves, purified again, the filter housing 2 by way of the outlet connector 4.

Figure 4:
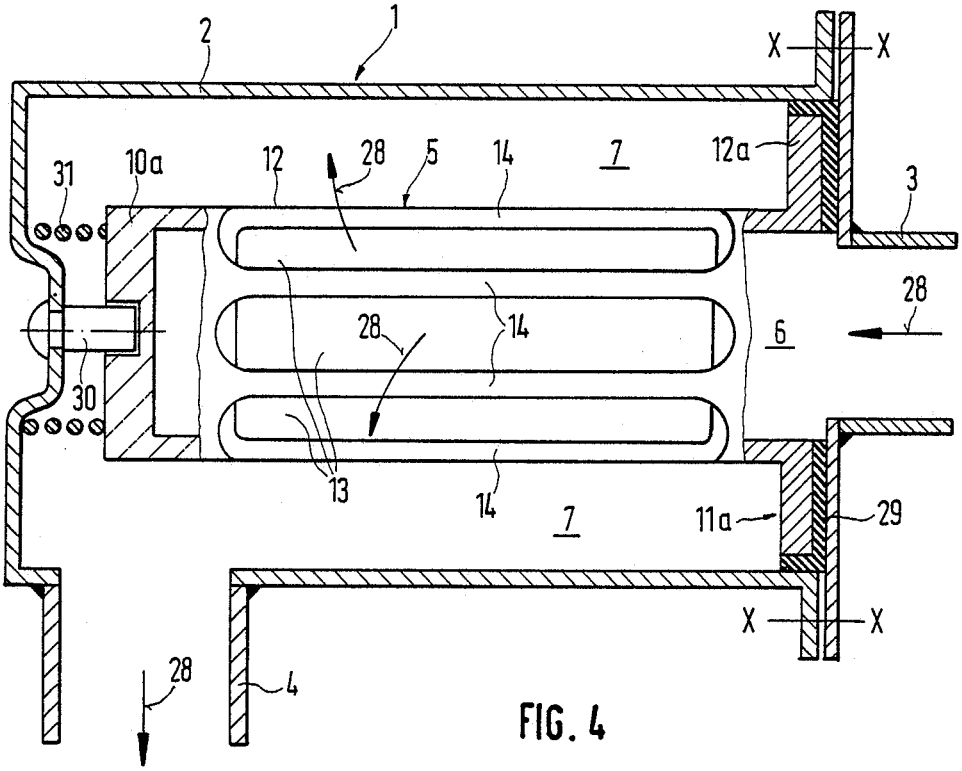
FIG. 4 is a longitudinal cross-sectional view of another exemplary embodiment of an apparatus according to the invention, whereby a wound or wrapped cage of ceramic material is used (likewise shown without a filter winding).

FIG. 4 shows an embodiment in which a ceramic wrapped cage is used as a support member for the filter means. In this connection, identical parts have the same reference numerals as in FIG. 1.

The ceramic molded body likewise comprises a base element 10*a*. A hollow cylinder 12, which is followed in turn by an inlet element 11*a*, is formed integrally with the base element 10*a*. The hollow cylinder 12 is provided on its periphery with longitudinal recesses 13 that extend over a specific area (winding or wrapping area). The hollow cylinder walls, which are formed between the recesses 13 and are referred to as winding-supporting webs or crosspieces 14, are metallized on the surface and are therefore capable of acting as electrodes (the necessary leads and insulating ducts have been omitted for the sake of clarity).

A centering bolt 30 holds the ceramic wrapped cage at the base end. With the aid of a spring 31 of highly heat-resistant material, the cage's flange surface 12*a* (part of the inlet element 11*a*) is pressed against the heat-resistant soft-material seal 29 that is shaped in such a way that it at the same time ensures a radial support of the flange part 12*a* against the filter housing 2.

Finally, the following should be mentioned: In the respective electrode arrangement, attention should be directed thereto that each electrode has a counter-polarity of the two directly adjacent electrodes opposite thereto. In this way only numbers of electrodes which amount to an even multiple of the number two are possible. With respect to the arrangement of the current supply, reference is made to the aforementioned U.S. patent application Ser. No. 069,609 Henkel filed July 2, 1987, belonging to the assignee of the present invention as well as to applicant's copending U.S. patent application Ser. No. 108,734 Henkel, filed Oct. 14, 1987, also belonging to the assignee of the present invention, both of which are hereby incorporated into this disclosure by this reference thereto.

The present invention is, of course, in no way restricted to the specific disclosure of the specification and drawings, but also encompasses any modifications within the scope of the appended claims.

What I claim is:

1. In an apparatus for removing soot from the exhaust gases of an internal combustion engine, especially a Diesel engine, said apparatus including a metallic housing with inlet and outlet connectors for the exhaust gas flow, and a filter insert that is disposed in the housing and contains a non-metallic, high-temperature resistant filter means in the form of a wrap structure mounted on a support member, with said filter insert, in said filter housing, separating an untreated-gas chamber from a clean-gas chamber, and with an electric current source being used to burn off, in a controlled manner, the soot deposited on said filter means whereby the soot itself serves as an electrical heat conductor, for which purpose said filter insert is provided with an appropriate electrode configuration having electrodes, the improvement therewith wherein:

to form said filter means, said support member is in the form of a wrapped cage that has a central axis and that is provided with said wrap structure and also provides said electrode configuration having the electrodes, with untwisted roving threads having individual fibers being used that are wound on said cage parallel to the circumference thereof, i.e. that extend perpendicular to the central axis of said cage, to form said wrap structure of said wrapped cage, said roving threads being wound tightly so that a very high degree of soot deposition occurs in capillary gaps that are oriented parallel to individual fibers of the roving and, in addition, there results an electrical conductivity of a layer of soot formed having a preferred direction, namely in the direction of formation of the capillary gaps, i.e. in the peripheral direction of the winding, and, since this direction of the conductivity coincides with the direction of an electrical field present between the electrodes, having a desired effect that even very small quantities of deposited soot form conductive paths that are formed in the manner of threads and can be heated electrically and consequently burned off.

2. In an apparatus for removing soot from the exhaust gases of an internal combustion engine, especially a Diesel engine, said apparatus including a metallic housing with inlet and outlet connectors for the exhaust gas flow, and a filter insert that is disposed in the housing and contains a non-metallic, high-temperature resistant filter means in the form of a wrap structure mounted on a support member, with said filter insert, in said filter housing, separating an untreated-gas chamber from a clean-gas chamber, and with an electric current source being used to burn off, in a controlled manner, the soot deposited on said filter means, for which purposes said filter insert is provided with an appropriate electrode configuration, the improvement wherein:

to form said filter means, said support member is in the form of a wrapped cage that is provided with said wrap structure and also provides said electrode configuration, with untwisted roving threads being used that are wound on said cage parallel to the circumference thereof, i.e. that extend perpendicular to the central axis of said cage, to form said wrap structure of said wrapped cage, said filter insert further including a base element and an inlet element, and said cage comprises a plurality of metallic support pins and tubular elements that are disposed at intervals to one another and define said circumference of said cage, said support pins and tubular elements being connected to said base element and said inlet element.

3. An apparatus according to claim 2, in which said base element comprises an outer cylindrical metal plate remote from said untreatedgas chamber, an inner cylindrical metal plate, a first insulating element disposed between said two plates, a first metallic annular disk, and a second insulating element disposed between said inner plate and said first annular disk, with said outer plate and said first annular disk, in conjunction with said support pins, undertaking the function of ground electrodes; and in which said inlet element includes a second metallic annular disk that is insulated against being grounded, with said inner plate, in conjunction with said tubular elements and said second annular disk, undertaking the function of live electrodes.

4. An apparatus according to claim 3, in which said tubular elements have end regions, the periphery of each of which is provided with a plurality of longitudinal slots of different lengths.

5. In an apparatus for removing soot from the exhaust gases of an internal combustion engine, especially a Deisel engine, said apparatus including a metallic housing with inlet and outlet connectors for the exhaust gas flow, and a filter insert that is disposed in the housing and contains a non-metallic, high-temperature resistant filter means in the form of a wrap structure mounted on a support member, with said filter insert, in said filter housing, separating an untreated-gas chamber from a clean-gas chamber, and with an electric current source being used to burn off, in a controlled manner, the soot deposited on said filter means, for which purpose said filter insert is provided with an appropriate electrode configuration, the improvement wherein:

to form said filter means, said support member is in the form of a wrapped cage that is provided with said wrap structure and also provides said electrode configuration, with untwisted roving threads being used that are wound on said cage parallel to the circumference thereof, i.e. that extend perpendicular to the central axis of said cage, to form said wrap structure of said wrapped cage, said filter insert further including a base element and an inlet element, and said cage is a ceramic cage that comprises a hollow cylinder that is integral with said base element; remote from the latter, said hollow cylinder has integrally formed thereon a flange surface that forms part of said inlet element; the periphery of said hollow cylinder is provided with longitudinal recesses that extend over a specific wrapping region, with crosspiece-like cylinder wall portions remaining between said recesses, these wall portions being externally metallized to undertake electrode functions.

6. An apparatus according to claim 5, in which said metallized crosspiece-like cylinder wall portions of said ceramic wrapped cage alternately undertake the functions of ground and live electrodes.

7. An apparatus according to claim 1, in which said wrap structure is in the form of a double-layer winding.

8. An apparatus according to claim 1, in which said filter winding that forms said wrap structure has two ends, with these ends being reinforced radially by being in the form of a multi-layer winding.

9. An apparatus according to claim 2, in which said wrap structure is in the form of a double-layer winding.

10. An apparatus according to claim 2, in which said filter winding that forms said wrap structure has two ends, with these ends being reinforced radially by being in the form of a multi-layer winding.

11. An apparatus according to claim 5, in which said wrap structure is in the form of a double-layer winding.

12. An apparatus according to claim 5, in which said filter winding that forms said wrap structure has two ends, with these ends being reinforced radially by being in the form of a multi-layer winding.

* * * * *